US009964901B2

(12) United States Patent
Takahashi

(10) Patent No.: US 9,964,901 B2
(45) Date of Patent: May 8, 2018

(54) IMAGE FORMING APPARATUS

(71) Applicant: KYOCERA Document Solutions Inc., Osaka (JP)

(72) Inventor: Hironori Takahashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/424,940

(22) Filed: Feb. 6, 2017

(65) Prior Publication Data

US 2017/0255138 A1 Sep. 7, 2017

(30) Foreign Application Priority Data

Mar. 1, 2016 (JP) ..... 2016-038531

(51) Int. Cl.
*G03G 15/20* (2006.01)

(52) U.S. Cl.
CPC ..... *G03G 15/2028* (2013.01)

(58) Field of Classification Search
CPC ..... G03G 15/2028
See application file for complete search history.

(56) References Cited

U.S. PATENT DOCUMENTS 5,839,032 A * 11/1998 Yasui ..... G03G 15/231 271/184

FOREIGN PATENT DOCUMENTS

JP 2001-075382 A 3/2001

* cited by examiner

*Primary Examiner* — Clayton E Laballe
*Assistant Examiner* — Jas Sanghera
(74) *Attorney, Agent, or Firm* — Studebaker & Brackett PC

(57) ABSTRACT

An image forming apparatus includes an apparatus main body, a fixing device, a conveying guide and a branching guide. In the apparatus main body, a conveying path and an inversion path are formed. The conveying guide guides the sheet along the conveying path closer to a downstream side than the fixing device. The branching guide guides the sheet toward an ejecting part along the conveying path closer to the downstream side than the fixing device and guides the sheet toward the inversion path along the conveying path closer to the downstream side than the fixing device. The conveying guide is detachably attached to one of the apparatus main body and the fixing device so as to cover a part of the fixing device from a downstream side in a conveying direction of the sheet. The branching guide is detachably attached to the conveying guide.

8 Claims, 9 Drawing Sheets

IMAGE FORMING APPARATUS

INCORPORATION BY REFERENCE

This application is based on and claims the benefit of priority from Japanese Patent application No. 2016-038531 filed on Mar. 1, 2016, which is incorporated by reference in its entirety.

BACKGROUND

The present disclosure relates to an image forming apparatus such as a printer and a copying machine.

An electrophotographic type image forming apparatus includes a fixing device which fixes a toner image transferred on a sheet, such as a paper, to the sheet.

An example of the fixing device includes a heating unit and a pressuring member. The heating unit heats a recording material via a film which rotates inside a fixing cover. The pressuring member comes into pressure contact with the heating unit to form a nip part. The fixing device further includes a separating claw which extends from the fixing cover and comes in contact with the film. The separating claw is arranged closer to a downstream side than the nip part in a rotation direction of the film. The separating claw is configured to separate the recording material wound around the film from the film. This prevents the recording material from being entirely wound around the film.

SUMMARY

In accordance with an aspect of the present disclosure, an image forming apparatus includes an apparatus main body, a fixing device, a conveying guide and a branching guide. In the apparatus main body, a conveying path and an inversion path are formed. The conveying path extends from a feeding part for a sheet to an ejecting part for the sheet. The inversion path branches from a portion on a downstream side of the conveying path and joins to a portion on an upstream side of the conveying path. The fixing device fixes an image on the sheet conveyed along the conveying path. The conveying guide guides the sheet along the conveying path closer to the downstream side than the fixing device. The branching guide guides the sheet toward the ejecting part along the conveying path closer to the downstream side than the fixing device and guides the sheet toward the inversion path along the conveying path closer to the downstream side than the fixing device. The conveying guide is detachably attached to one of the apparatus main body and the fixing device so as to cover a part of the fixing device from a downstream side in a conveying direction of the sheet. The branching guide is detachably attached to the conveying guide.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, a preferable embodiment of the present disclosure will be described. The following description is based on directions shown in each figure.

Figure 1:
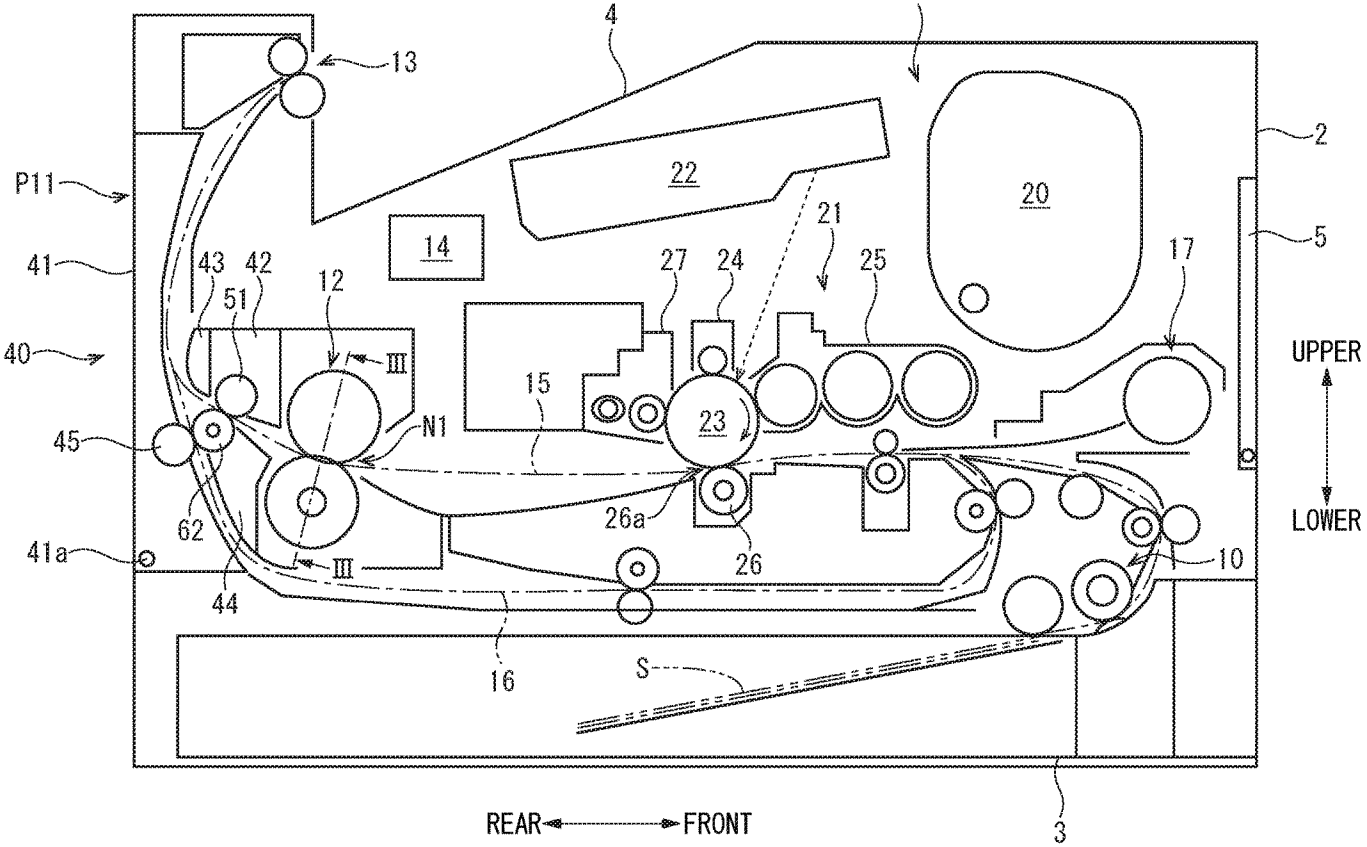
FIG. 1 is a sectional view schematically showing an inner structure of a printer according to an embodiment of the present disclosure.

With reference to FIG. 1, a printer 1 as an image forming apparatus according to the embodiment will be described. FIG. 1 is a sectional view schematically showing an inner structure of the printer 1. In the following description, "a conveying direction" shows a conveying direction in which a sheet S is conveyed. In addition, "an upstream", "a downstream" and other similar descriptions respectively show "an upstream" side in the conveying direction, "a downstream" side in the conveying direction and other similar concept.

The printer 1 includes an apparatus main body 2, a sheet feeding cassette 3 and an ejecting tray 4. The sheet feeding cassette 3 as a feeding part for a sheet is provided in a lower portion of the apparatus main body 2 so as to be detachably inserted in the front and rear direction. In the sheet feeding cassette 3, the sheets S (a bundle of sheets) are stored. The ejecting tray 4 as an ejecting part for the sheet is formed on an upper face of the apparatus main body 2. On a front face of the apparatus main body 2, a manual bypass tray 5 is turnably provided.

Inside of the apparatus main body 2, a conveying path 15 and an inversion path 16 are formed. The conveying path 15 extends from the sheet feeding cassette 3 to the ejecting tray 4. The inversion path 16 extends below the conveying path 15. The inversion path 16 branches from a downstream side portion of the conveying path 15 and joins to an upstream side portion of the conveying path 15.

The printer 1 further includes a sheet feeding mechanism 10, an image forming part 11, a fixing device 12, an ejecting mechanism 13 and a control device 14. The sheet feeding mechanism 10 is disposed on an upstream side end portion of the conveying path 15. The image forming part 11 and the fixing device 12 are disposed on a middle portion of the conveying path 15. The ejecting mechanism 13 is disposed on a downstream side end portion of the conveying path 15. The control device 14 totally controls each configuration of the printer 1. Near the manual bypass tray 5, a manual feeding mechanism 17 is provided.

The sheet feeding mechanism 10 feeds the sheet S stored in the sheet feeding cassette 3 toward the conveying path 15 one by one. The manual feeding mechanism 17 feeds the sheet S placed on the manual bypass tray 5 toward the conveying path 15 one by one. The conveying path 15 is formed so as to curve upward at a portion closer to the downstream side than the fixing device 12 and extend upward. The inversion path 16 is formed so as to branch from the conveying path 15 at a portion closer to the downstream side than the fixing device 12, curve downward and extend forward. On each of the conveying path 15 and the inversion path 16, a plurality of detecting devices (not shown) are disposed in order to detect conveying failure (jamming) of the sheet S. Each detecting device is electrically connected to the control device 14 and transmits an electrical signal showing occurrence of the jamming to the control device 14.

The image forming part 11 has a toner container 20, a drum unit 21 and an optical scanning device 22. The toner container 20 contains a toner (a developer) of black color, for example. The drum unit 21 has a photosensitive drum 23, a charging device 24, a developing device 25, a transferring roller 26 and a cleaning device 27. The charging device 24, the developing device 25, the transferring roller 26 and the cleaning device 27 are disposed around the photosensitive drum 23 in the order of transferring process. The transferring roller 26 comes into pressure contact with the photosensitive drum 23 from the lower side to form a transferring nip 26*a*.

Here, an operation of the printer 1 will be described. The control device 14 executes the following image forming operation based on an input image date.

The charging device 24 charges a surface of the photosensitive drum 23. The optical scanning device 22 exposes the photosensitive drum 23 based on the image data (refer to a dashed arrow in FIG. 1). The developing device 25 develops a latent image on the photosensitive drum 23 to a toner image. On the other hand, the sheet S is conveyed from the sheet feeding cassette 3 (or the manual bypass tray 5) to the conveying path 15. The toner image is transferred on a front face of the sheet S passing through the transferring nip 26*a*. The fixing device 12 fixes the toner image on the sheet S. After the fixing processing, the sheet S is ejected by the ejecting mechanism 13 on the ejecting tray 4.

When an image is formed on both faces of the sheet S, the ejecting mechanism 13 reverses the sheet S and feeds it to the inversion path 16. The sheet S is conveyed along the inversion path 16 and then conveyed along the conveying path 15 again toward the transferring nip 26*a*. In this way, an image is formed on a rear face of the sheet S.

Figure 2:
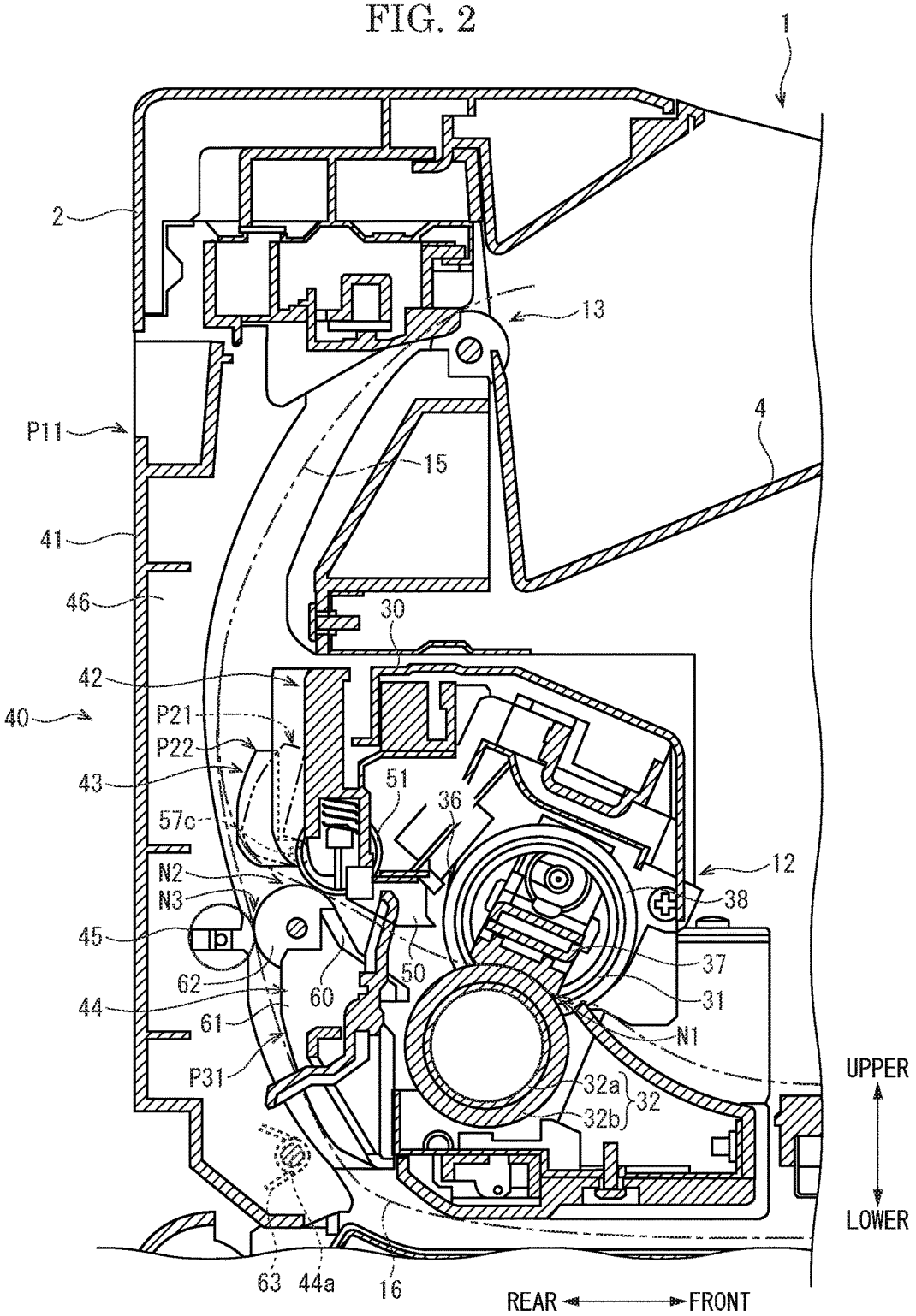
FIG. 2 is a sectional view showing a rear portion of the printer according to the embodiment of the present disclosure.
Figure 3:
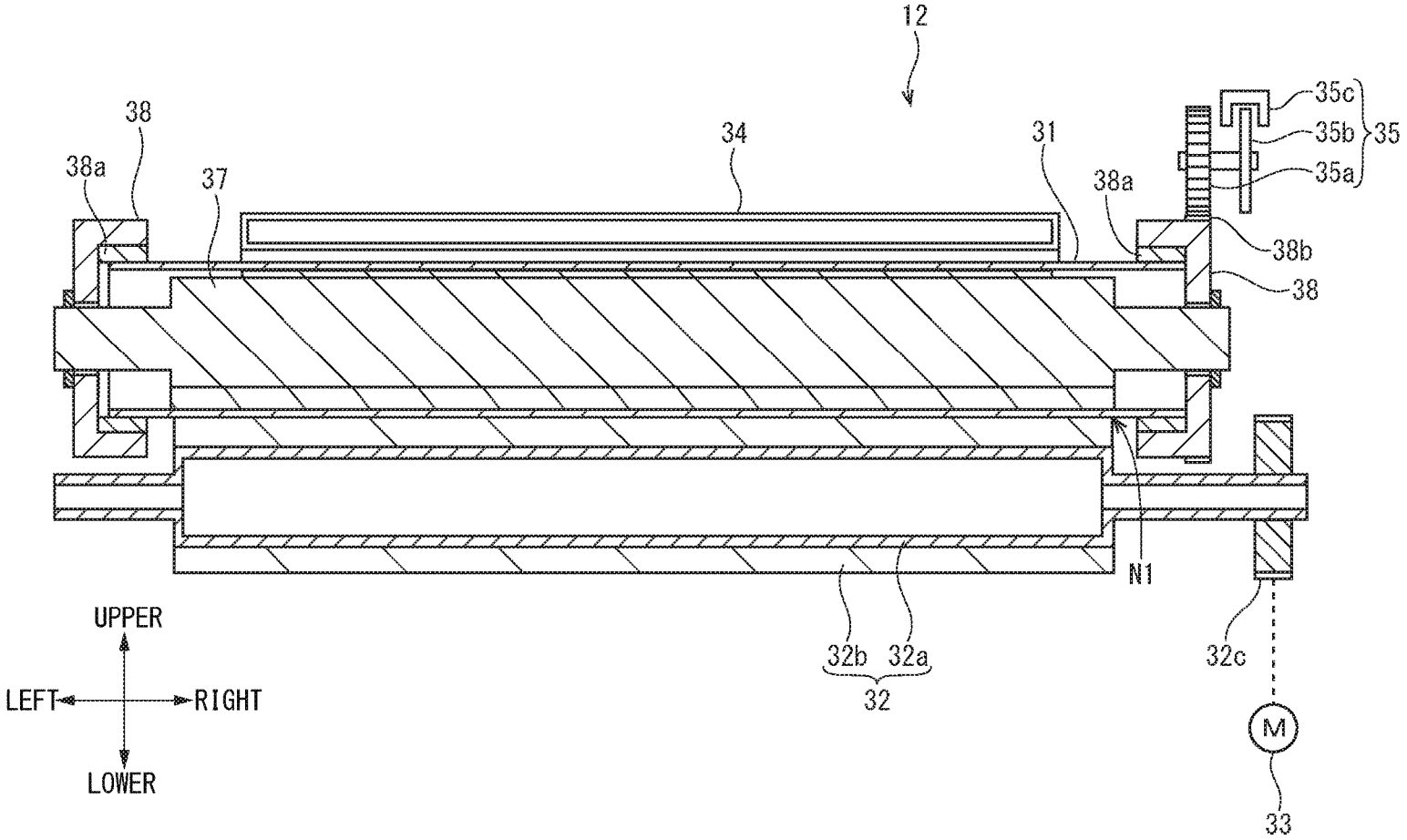
FIG. 3 is a III-III sectional view of FIG. 1.

Next, with reference to FIGS. 2 and 3, the fixing device 12 will be described. FIG. 2 is a sectional view showing a rear portion of the printer 1. FIG. 3 is a III-III sectional view of FIG. 1.

The fixing device 12 employs a so-called sliding belt type. The fixing device 12 has a fixing frame 30, a fixing belt 31, a pressuring roller 32, a fixing driving part 33, an induction heating (IH) heater 34, a rotation detecting mechanism 35 and a separating claw 36.

The fixing belt 31 as a fixing member has flexibility, and is formed into an endless shape. The fixing belt 31 is formed into a cylindrical shape elongated in the left and right direction (a direction of a rotation axis). The fixing belt 31 is supported by the fixing frame 30 so as to be capable of rotating (circulating) around the rotation axis. The fixing belt 31 is formed by laminating a substrate layer, an elastic layer and a releasing layer in the order from an inner side (they are not shown). The substrate layer is made of polyimide resin mixed with nickel or metal powder, for example. The elastic layer is made of silicon rubber, for example. The releasing layer is made of fluororesin, for example.

In an inner hollow space of the fixing belt 31, a pressing member 37 is non-rotatably disposed. The pressing member 37 presses the fixing belt 31 on the pressuring roller 32. On both ends of the fixing belt 31 in the left and right direction (the direction of the rotation axis), a pair of left and right caps 38 are attached. Between an inner circumferential face of each cap 38 and an outer circumferential face of the fixing belt 31, an annular elastic member 38*a* is interposed. Around an outer circumferential face of each cap 38, a connecting gear 38*b* is formed. Both left and right ends of the above described pressing member 37 are loosely fitted into the pair of left and right caps 38.

The pressuring roller 32 as a pressuring member is formed into a cylindrical shape elongated in the left and right direction. The pressuring roller 32 is supported by the fixing frame 30 so as to be rotatable around a rotation axis. The pressuring roller 32 comes into pressure contact with the fixing belt 31 from the lower side of the fixing belt 31. Between the fixing belt 31 and the pressuring roller 32, a fixing nip N1 is formed. The pressuring roller 32 is formed by laminating an elastic layer 32*b* on an outer circumferential face of a core material 32*a*, for example. The core material 32*a* is made of metal, such as stainless steel and aluminum, for example. The elastic layer 32*b* is made of silicon rubber or silicon sponge, for example. On an outer circumferential face of the elastic layer 32*b*, a releasing layer (fluororesin or the like, not shown) is laminated.

As shown in FIG. 3, the fixing driving part 33 has a motor, a gear train and the others (they are not shown). The fixing driving part 33 is connected to a driving gear 32*c* fixed to one end portion (a right end portion) of the core material 32*a*. The fixing driving part 33 drives the pressuring roller 32 to rotate it around the rotation axis.

The IH heater 34 as a heat source is disposed on an upper side (an opposing side to the fixing nip N1) of the fixing belt 31. The IH heater 34 generates magnetic field to heat the fixing belt 31. The fixing device 12 heats and presses the sheet S passing through the fixing nip N1 to fix the toner image on the sheet S.

The rotation detecting mechanism 35 has a transmitting gear 35*a*, a rotating pulse plate 35*b* and a rotation detecting sensor 35*c*.

The transmitting gear 35*a* meshes with the connecting gear 38*b* of the right cap 38 to transmit rotation of the fixing belt 31 to the rotating pulse plate 35*b*. The rotating pulse plate 35*b* has a plurality of light-shielding pieces (not shown) aligned in a circumferential direction at equal intervals. The rotation detecting sensor 35*c* is a photo-interrupter having a light emitting part and a light receiving part which oppose to each other on both sides of the rotating pulse plate 35*b*. The rotation detecting sensor 35*c* transmits light receiving information changing depending on rotation of the rotating pulse plate 35*b* to the control device 14. One or more rotation detecting sensor 35*c* may be provided so as to detect rotation of at least one of the pair of left and right caps 38.

As shown in FIG. 2, the separating claw 36 as a separating member is disposed closer to the downstream side of the conveying path 15 than the fixing nip N1. The separating claw 36 is disposed closer to a downstream side than the fixing nip N1 in the rotation direction of the fixing belt 31. A proximal end portion of the separating claw 36 is supported by the fixing frame 30. The separating claw 36 is provided such that a distal end portion of the separating claw 36 is close to the outer circumferential face of the fixing belt 31 from a counter direction opposing to the rotation direction of the fixing belt 31. The separating claw 36 is configured to separate the sheet S wound around the fixing belt 31 from the fixing belt 31. A gap between the distal end portion of the separating claw 36 and the circumferential face of the fixing belt 31 is set to be within a range from 0.1 to 0.5 mm, for example. The separating claw 36 may be provided such that the distal end portion comes in contact with the fixing belt 31.

When the sheet S begins to be wound around the fixing belt 31 after passing through the fixing nip N1, the separating claw 36 peels off the sheet S from the fixing belt 31. However, in rare cases, the sheet S enters the gap between the fixing belt 31 and the separating claw 36, and conveying failure of the sheet S (jamming) may occur. One of the plurality of detecting devices described above is configured to be able to detect the jamming of the sheet S occurred in the fixing device 12. When the jamming occurs in the fixing device 12, the detecting device transmits a signal showing the occurrence of the jamming to the control device 14. The control device 14 recognizes the occurrence of the jamming and then stops the image forming operation. After that, the control device 14 displays a message showing the occurrence of the jamming on a liquid crystal display panel (not shown). A user performs a jamming processing (a jamming releasing) according to the massage displayed on the liquid crystal display panel.

Figure 4:
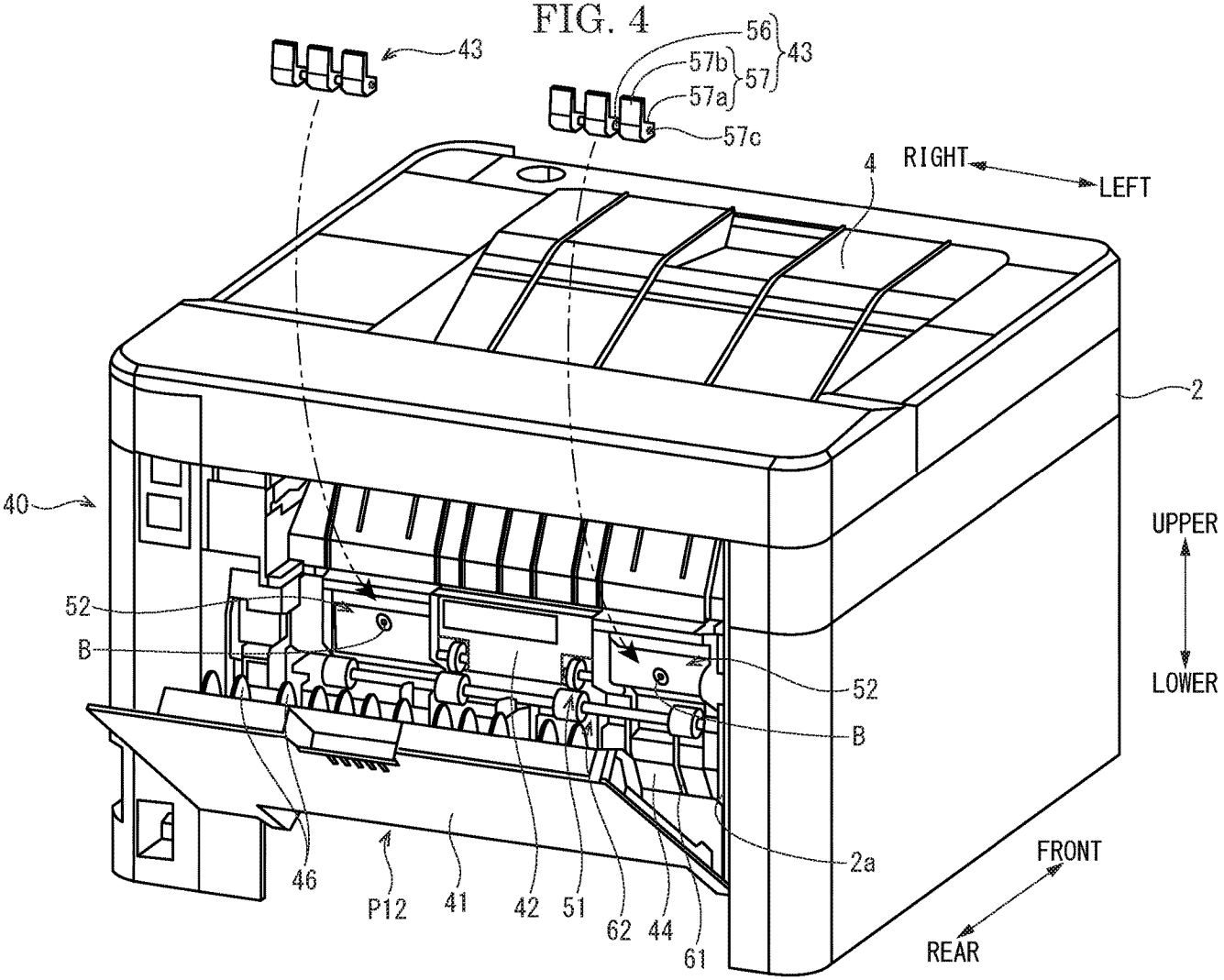
FIG. 4 is a perspective view showing the printer according to the embodiment of the present disclosure.
Figure 5:
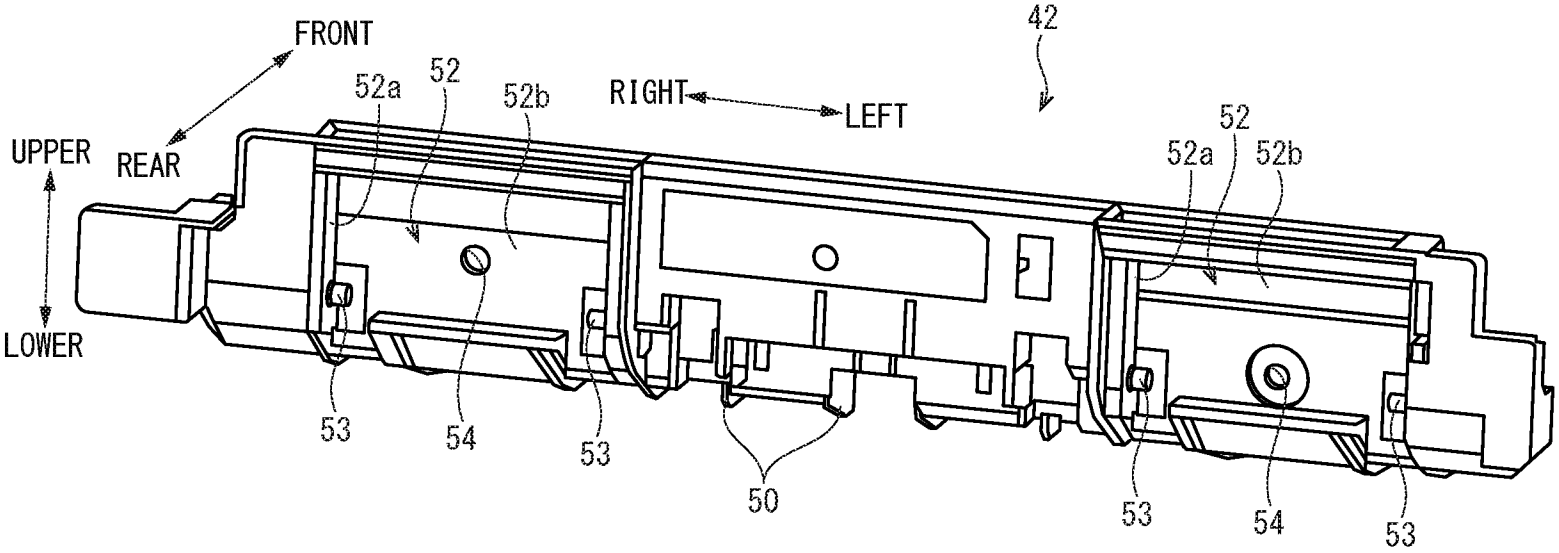
FIG. 5 is a rearward perspective view showing a conveying guide of a jamming processing structure of the printer according to the embodiment of the present disclosure.
Figure 6:
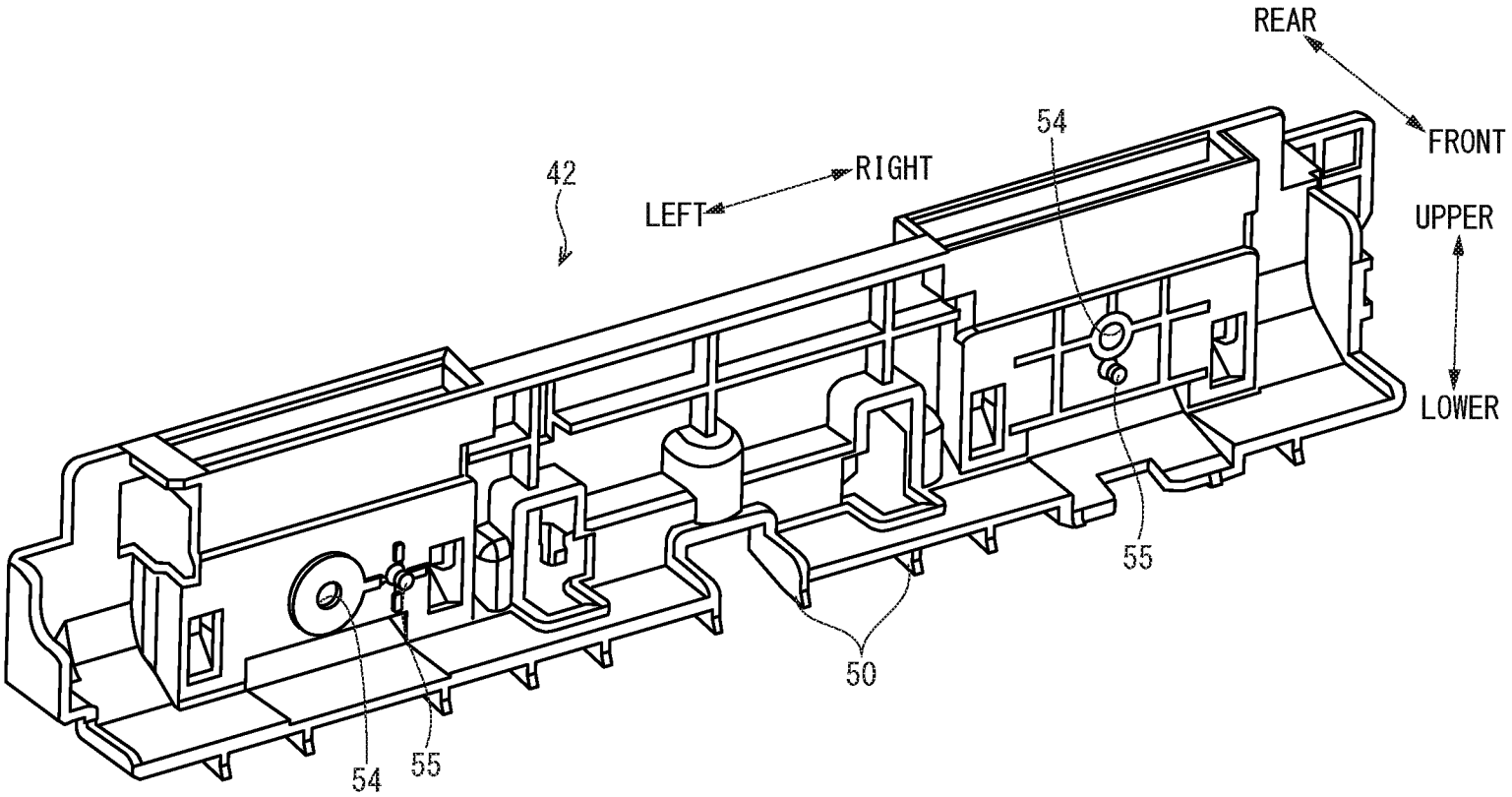
FIG. 6 is a forward perspective view showing the conveying guide of the jamming processing structure of the printer according to the embodiment of the present disclosure.
Figure 7:
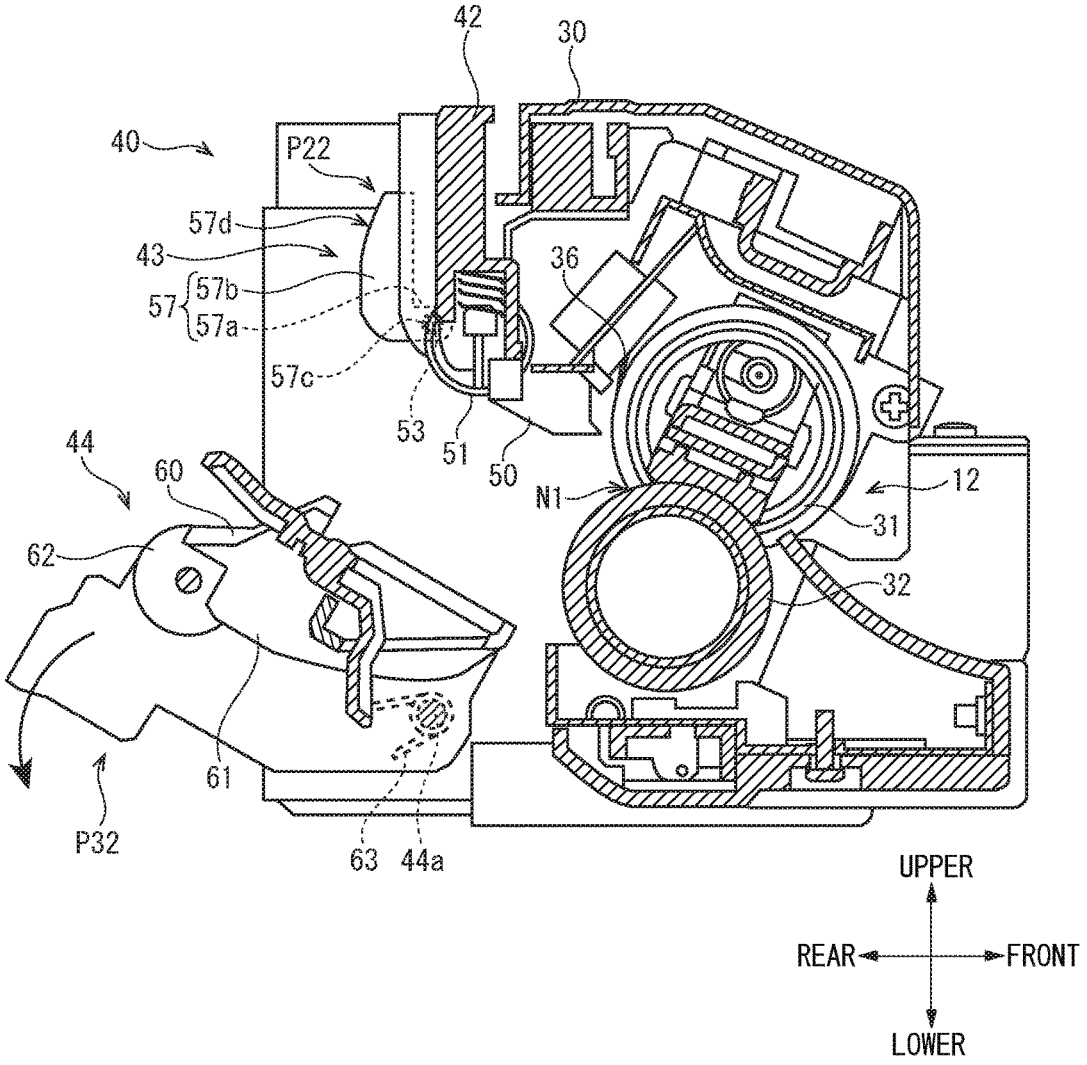
FIG. 7 is a sectional view showing the jamming processing structure of the printer according to the embodiment of the present disclosure.
Figure 8:
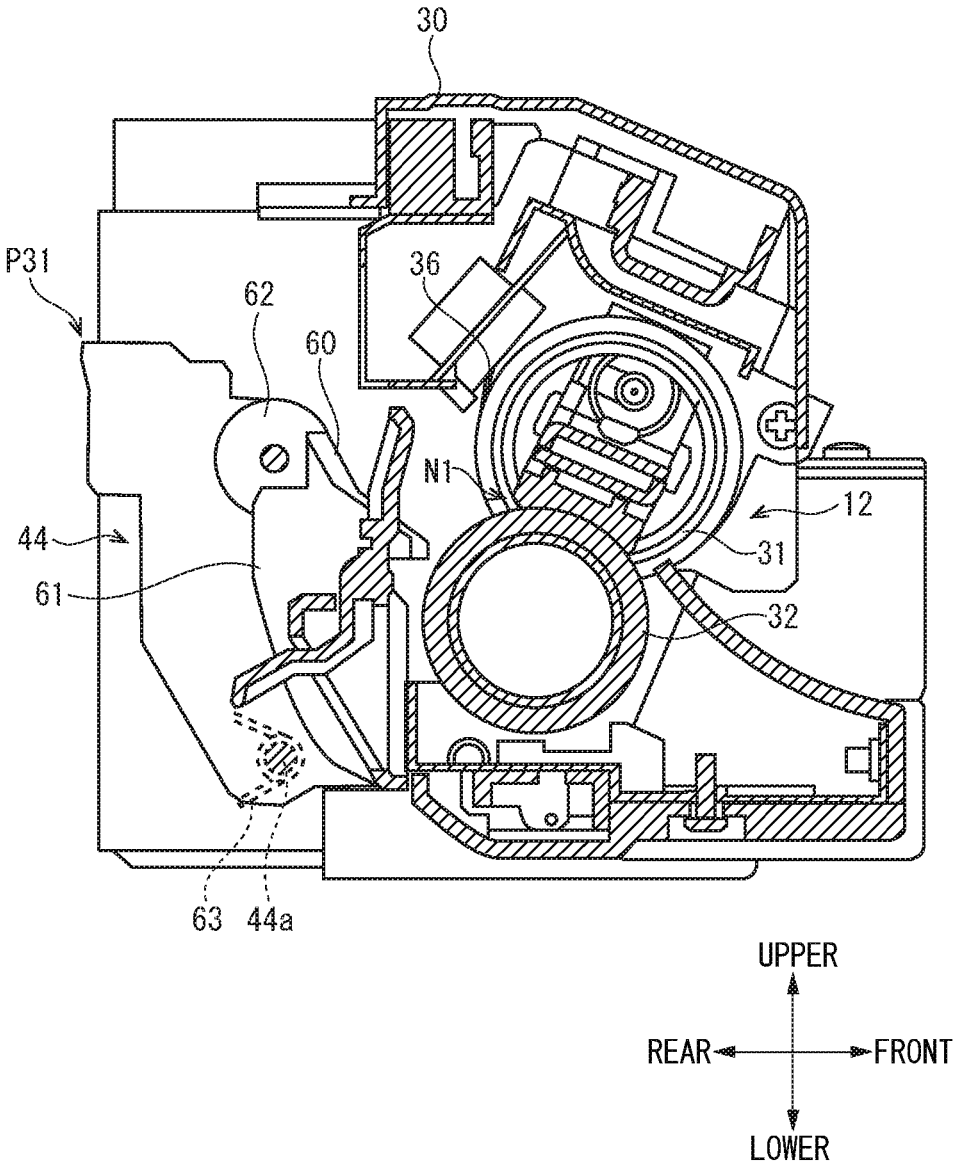
FIG. 8 is a sectional view explaining an operation of the jamming processing structure of the printer according to the embodiment of the present disclosure.
Figure 9:
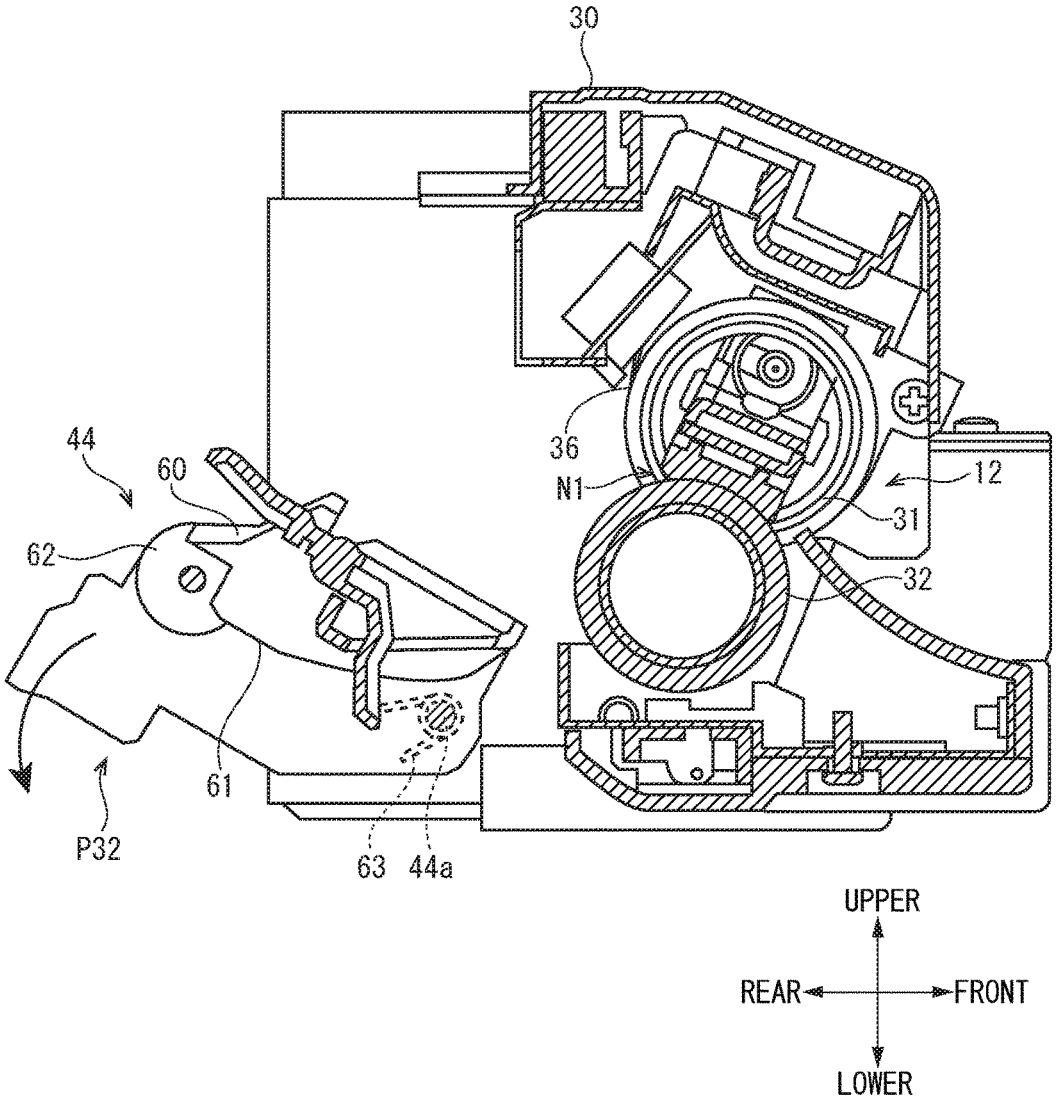
FIG. 9 is a sectional view explaining the operation of the jamming processing structure (turning of an opening/closing guide) of the printer according to the embodiment of the present disclosure.

The printer 1 of the present embodiment includes a jamming processing structure 40 in order to remove the sheet S jammed near the fixing device 12. With reference to FIGS. 1, 2, 4 to 9, the jamming processing structure 40 will be described. FIG. 4 is a perspective view showing the printer 1. FIG. 5 is a rearward perspective view showing a conveying guide 42 of the jamming processing structure 40. FIG. 6 is a forward perspective view showing the conveying guide 42 of the jamming processing structure 40. FIG. 7 is a sectional view showing the jamming processing structure 40. FIG. 8 is a sectional view explaining an operation of the jamming processing structure 40. FIG. 9 is a sectional view explaining the operation of the jamming processing structure 40 (turning of an opening/closing guide 44).

As shown in FIGS. 2 and 4, the jamming processing structure 40 includes a cover 41, a conveying guide 42, a pair of left and right branching guides 43 and an opening/closing guide 44. The cover 41 is capable of opening and closing a rear opening 2*a* opened on the rear face of the apparatus main body 2. The conveying guide 42, each branching guide 43 and the opening/closing guide 44 are provided inside of the apparatus main body 2.

As shown in FIG. 2, the cover 41 is formed into a substantially rectangular plate shape, and made of synthetic resin, for example. On a lower portion of the cover 41, a cover roller 45 is rotatably supported. The cover roller 45 has a plurality of rollers (for example, four rollers) fixed to a shaft. On the lower portion of the cover 41, a pair of left and right cover rotation shafts 41*a* is formed. The cover 41 is supported by the apparatus main body 2 so as to be turnable around each cover rotation shaft 41*a*. The cover 41 is configured to be turnable between a closing position P11 (refer to FIG. 2) where the cover 41 closes the rear opening 2*a* and an opening position P12 (refer to FIG. 4) where the cover 41 opens the rear opening 2*a*.

As shown in FIGS. 1 and 2, when the cover 41 is turned to the closing position P11, an outer face of the cover 41 forms the rear face of the apparatus main body 2. In addition, when the cover 41 is turned to the closing position P11, an inner face of the cover 41 forms one face of the conveying path 15 closer to the downstream side than the fixing device 12 and one face of the upstream side portion of the inversion path 16. On the inner face of the cover 41, a plurality of cover side ribs 46 are stood in order to convey the sheet S smoothly (refer to FIG. 4). The plurality of cover side ribs 46 are adjacently arranged in the left and right direction at predetermined intervals.

On the other hand, as shown in FIG. 4, when the cover 41 is turned to the opening position P12, the other face of the conveying path 15 closer to the downstream side than the fixing device 12 and the other face of the upstream side portion of the inversion path 16 are exposed. Thereby, a maintenance work, such as the jamming processing, can be performed.

The conveying guide 42 is formed into a substantially rectangular parallelepiped shape elongated in the left and right direction, and made of synthetic resin, for example (refer to FIGS. 5 and 6). As shown in FIG. 2, the conveying guide 42 is configured to cover the fixing belt 31 from the downstream side in the conveying direction. The conveying guide 42 forms an upper face of the conveying path 15 closer to the downstream side than the fixing device 12. On a lower face of the conveying guide 42, a plurality of upper side ribs 50 are stood in order to convey the sheet S smoothly (refer to FIGS. 5 and 6). The plurality of upper side ribs 50 are adjacently arranged in the left and right direction at predetermined intervals. The conveying guide 42 guides the sheet S which has passed through the fixing device 12 (the fixing nip N1) toward the downstream side of the conveying path 15 along the conveying path 15 closer to the downstream side than the fixing device 12.

On a rear side lower portion of the conveying guide 42, a driven roller 51 as a first roller is rotatably supported. The driven roller 51 has a pair of left and right rollers fixed to a shaft. As shown in FIGS. 4 and 5, on a rear face of the conveying guide 42, a pair of left and right guide placement parts 52 is recessed. Each guide placement part 52 is a recess which has a substantially rectangular shape viewed from the rear side and is opened on a side of the conveying path 15 (the rear side). On both inner side faces 52*a* of each guide placement part 52, column shaped axis bosses 53 are protruded (refer to FIG. 5). Each axis boss 53 is provided on a lower portion of each guide placement part 52.

As shown in FIGS. 5 and 6, on a substantially center of a bottom face 52*b* of each guide placement part 52, a through hole 54 is penetrated. In detail, the right through hole 54 is positioned on the substantially center of the bottom face 52*b* and the left through hole 54 is positioned on the lower side than the substantially center of the bottom face 52*b*.

As shown in FIG. 6, on a front face of the conveying guide 42, a pair of left and right positioning bosses 55 are protruded. The left positioning boss 55 is positioned on the right side of the left through hole 54 and the right positioning boss 55 is positioned on the lower side of the right through hole 54. Each positioning boss 55 is fitted into a positioning recess (not shown) formed in the fixing frame 30.

By fitting each positioning boss 55 into each positioning recess, the conveying guide 42 is positioned to the fixing frame 30. Two screws B as fastening members penetrate through the through holes 54 from the rear side toward the front side and are screwed to screw holes (not shown) formed in the fixing frame 30. That is, the conveying guide 42 is attached to the fixing device 12 (the fixing frame 30) with the two screws B (refer to FIG. 4). As described above, the conveying guide 42 is configured to detachably attached to the fixing device 12 so as to cover an upper portion (a part) of the fixing device 12 from the downstream side in the conveying direction (refer to FIG. 2).

As shown in FIGS. 2 and 4, each of the pair of left and right branching guides 43 has three branching ribs 57 connected by a connecting part 56. Each branching ribs 57 and the connecting part 56 are integrally formed together, and made of synthetic resin, for example. Each of the pair of left and right branching guides 43 is arranged in the guide placement part 52 of the conveying guide 42. The branching guides 43 have the same shape and one of the branching guides 43 will be described.

The three branching ribs 57 are adjacently arranged in the left and right direction at equal intervals. Each branching rib 57 has a rib supporting portion 57*a* and a rib main body 57*b* stood on a tip end portion of the rib supporting portion 57*a*, and is formed into a substantially L-shape in a side view (refer to FIG. 7). The three rib supporting portions 57*a* are fixed to the connecting part 56. The left and right rib supporting portions 57*a* each have a bearing portion 57*c* formed into a recess. The rib main body 57*b* has an inclined face 57*d* inclined forward to the upper direction (refer to FIG. 7). The rib main body 57*b* protrudes the inclined face 57*d* toward the conveying path 15. The branching guide 43 (the rib main body 57*b* of each branching rib 57) forms the other face of the conveying path 15 closer to the downstream side than the fixing device 12.

The pair of left and right axis bosses 53 protruded on each guide placement part 52 of the conveying guide 42 is fitted into the pair of left and right bearing portions 57*c* of the branching guide 43 such that they are relatively rotatable (refer to FIG. 7). In this state, the branching guide 43 is configured to be detachably attached to the guide placement part 52 of the conveying guide 42. The branching guide 43 is attached to the conveying guide 42 so as to cover the screw B from the side of the conveying path 15 (the rear side).

The branching guide 43 is supported so as to be turnable around the bearing portions 57*c* (the axis bosses 53). In detail, as shown in FIG. 2, the branching guide 43 is configured to be turnable between an ejection position P21 where the branching guide 43 rubs on the sheet S conveyed toward the downstream side of the conveying path 15 after the sheet S has passed through the conveying guide 42 and a reverse conveying prevention position P22 where the branching guide 43 rubs on the sheet S conveyed toward the inversion path 16 after the sheet S has passed through the conveying guide 42.

The sheet S conveyed toward the ejecting tray 4 turns the branching guide 43 forward (in a direction of the bottom face 52*b* of the guide placement part 52). That is, the branching guide 43 is turned to the ejection position P21 and a tip end portion (an upper end portion) of the rib main body 57*b* is turned forward (refer to a two-dotted line in FIG. 2). The sheet S rubs on the branching guide 43 turned to the ejection position P21 to be guided to the downstream side of the conveying path 15. Thereby, the sheet S which has passed through the conveying guide 42 can be guided to the ejecting tray 4.

On the other hand, the sheet S conveyed toward the inversion path 16 turns the branching guide 43 rearward (in a direction separate from the bottom face 52*b* of the guide placement part 52). That is, the branching guide 43 is turned to the reverse conveying prevention position P22 and the tip end portion (the upper end portion) of the rib main body 57*b* is turned rearward (refer to a solid line in FIG. 2). The sheet S rubs on the branching guide 43 turned to the reverse conveying prevention position P22 to be guided to the inversion path 16. Thereby, the sheet S to be reversed can be prevented from entering the conveying path 15 again (reverse conveying).

As described above, the branching guide 43 guides the sheet S which has passed through the conveying guide 42 toward the ejecting tray 4 along the conveying path 15 closer to the downstream side than the fixing device 12. In addition, the branching guide 43 guides the sheet S which has passed through the conveying guide 42 toward the inversion path 16 along the conveying path 15 closer to the downstream side than the fixing device 12.

As shown in FIGS. 2, 4 and 7, the opening/closing guide 44 is formed into a substantially rectangular parallelepiped shape elongated in the left and right direction, and made of synthetic resin, for example. The opening/closing guide 44 is configured to cover the pressuring roller 32 from the downstream side in the conveying direction. The opening/closing guide 44 forms a lower face of the conveying path 15 closer to the downstream side than the fixing device 12. On an upper face of the opening/closing guide 44, a plurality of lower side ribs 60 are stood in order to convey the sheet S smoothly. The plurality of lower side ribs 60 are adjacently arranged in the left and right direction at predetermined intervals.

The opening/closing guide 44 forms the other face of the upstream side portion of the inversion path 16. On a rear face of the opening/closing guide 44, a plurality of rear side ribs 61 are stood. The plurality of rear side ribs 61 are adjacently arranged in the left and right direction at predetermined intervals.

On a rear side upper portion of the opening/closing guide 44, a driving roller 62 as a second roller is rotatably supported. The driving roller 62 has a plurality of rollers (for example, four rollers) fixed to a shaft. The driving roller 62 is connected to a driving motor via a gear train.

The opening/closing guide 44 is rotatably supported by the apparatus main body 2 around an opening/closing shaft 44*a*. In detail, the opening/closing guide 44 is supported by the apparatus main body 2 so as to be turnable between a supporting position P31 (refer to FIG. 2) where the opening/closing guide 44 supports the conveying guide 42 from the lower side and a leaving position P32 (refer to FIG. 7) where the opening/closing guide 44 leaves from the lower side of the conveying guide 42. Around the opening/closing shaft 44*a*, a torsion coil spring 63 as a biasing member is fitted. The torsion coil spring 63 biases the opening/closing guide 44 toward the supporting position P31.

As shown in FIG. 2, when the opening/closing guide 44 is turned to the supporting position P31, the driving roller 62 comes into pressure contact with the driven roller 51. When the opening/closing guide 44 is turned to the supporting position P31 and the cover 41 is turned to the closing position P11, the cover roller 45 comes into pressure contact with the driving roller 62. Between the driving roller 62 and the driven roller 51, a conveying nip N2 is formed along the conveying path 15. Between the driving roller 62 and the cover roller 45, an inversion nip N3 is formed along the inversion path 16. The driving roller 62 is driven by the driving motor to be rotated. The driven roller 51 and the cover roller 45 are driven by the driving roller 62 to be rotated. The sheet S is conveyed through each of the conveying nip N2 and the inversion nip N3.

Here, an operation of the jamming processing structure 40 (a procedure of the jamming processing) will be described. The image forming operation is performed in a state where the cover 41 is turned to the closing position P11 and the opening/closing guide 44 is turned to the supporting position P31.

When the sheet S is jammed at the fixing device 12 during the image forming operation, the control device 14 displays a message on the liquid crystal display panel. A worker performs the jamming processing according to the message displayed on the liquid crystal display panel. First, the worker turns the cover 41 from the closing position P11 to the opening position P12 (refer to FIG. 4). Then, the inversion nip N3 is released and the rear opening 2*a* is opened. This makes it possible to access the inside of the apparatus main body 2.

When the sheet S is jammed on the downstream side of the fixing nip N1 or the conveying nip N2 in the conveying direction, the worker turns the opening/closing guide 44 from the supporting position P31 to the leaving position P32 (refer to FIG. 7). Then, the conveying nip N2 is released to expose the pressuring roller 32. The worker removes the jammed sheet S.

Next, for instance, when the sheet S is jammed in the gap between the fixing belt 31 and the separating claw 36, the fixing belt 31 of the fixing device 12 is exposed and then the jammed sheet S is removed. In this case, first, the worker releases each bearing portion 57*c* from each axis boss 53 to detach each branching guide 43 from the conveying guide 42. Then, the bottom face 52*b* of each guide placement part 52 of the conveying guide 42 is exposed and each screw B (a head of each screw B) which fastens the conveying guide 42 to the fixing frame 30 is also exposed (refer to FIG. 4). The worker loosens each screw B using a tool (a driver or the like) to detach them. After that, the worker detaches the conveying guide 42 from the fixing frame 30 (refer to FIG. 8). Thereby, a part of the fixing belt 31 is exposed so that the sheet S jammed in the gap between the fixing belt 31 and the separating claw 36 can be removed easily (the jamming processing).

As shown in FIG. 9, the jamming processing may be performed after the opening/closing guide 44 is turned from the supporting position P31 to the leaving position P32. By detaching the conveying guide 42 and turning the opening/closing guide 44 to the leaving position P32, the fixing device 12 (a portion near the downstream side portion of the fixing nip N1) is exposed. Thereby, the jamming processing in the fixing device 12 can be performed easily.

After the jamming processing, the worker performs an attachment work of the conveying guide 42 to the fixing frame 30. First, the worker fits each positioning boss 55 of the conveying guide 42 into each positioning recess (not shown) of the fixing frame 30. The worker turns the opening/closing guide 44 from the leaving position P32 to the supporting position P31 (refer to FIG. 8). The opening/closing guide 44 is biased by the torsion coil spring 63 to be supported to the supporting position P31. The opening/closing guide 44 turned to the supporting position P31 supports the conveying guide 42 from the lower side (refer to FIG. 2). Accordingly, the conveying guide 42 can be supported on the opening/closing guide 44 stably. Thereby, the attachment work of the conveying guide 42 can be performed easily. In addition, because the conveying guide 42 can be prevented from falling at the attachment work of the conveying guide 42, the conveying guide 42 and the fixing device 12 can be prevented from being damaged by the falling of the conveying guide 42.

The worker fastens the conveying guide 42 to the fixing frame 30 with each screw B and then makes the conveying guide 42 support each branching guide 43. After that, the worker turns the cover 41 from the opening position P12 to the closing position P11. That is, the worker performs a reverse procedure to the above detachment procedure.

According to the printer 1 of the present embodiment as described above, the conveying guide 42 which covers the fixing device 12 is configured to be detachably attached to the fixing device 12 (the fixing frame 30). Accordingly, by detaching the conveying guide 42 only, the fixing device 12 is exposed. Thereby, the sheet S jammed in the fixing device 12 can be removed easily without disassembling the fixing device 12. The conveying guide 42 may be detachably attached to the apparatus main body 2, instead of being detachably attached to the fixing frame 30.

According to the printer 1 of the present embodiment, each screw B is covered with each branching guide 43. That is, each screw B is provided at a position hard to be seen by the worker. In addition, after each branching guide 43 is detached, the detachment work of the screws B and the conveying guide 42 (the jamming processing work) becomes possible. Thereby, the detachment work of the screws B (the conveying guide 42) by one who does not have a correct knowledge about the jamming processing work is inhibited so that the fixing device 12 can be prevented from being damaged based on an incorrect jamming processing.

Although each embodiment was described in a case where configurations of the disclosure are applied to the monochromatic printer 1 as an example, the configurations of the disclosure may be applied to a color printer, a multifunctional peripheral, a copying machine, a facsimile or the like, other than the monochromatic printer 1.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. An image forming apparatus comprising:

an apparatus main body in which a conveying path and an inversion path are formed, the conveying path extending from a feeding part for a sheet to an ejecting part for the sheet, the inversion path branching from a portion on a downstream side of the conveying path and joining to a portion on an upstream side of the conveying path;

a fixing device which fixes an image on the sheet conveyed along the conveying path;

a conveying guide which guides the sheet along the conveying path closer to the downstream side than the fixing device; and a branching guide which guides the sheet toward the ejecting part along the conveying path closer to the downstream side than the fixing device and guides the sheet toward the inversion path along the conveying path closer to the downstream side than the fixing device, wherein the conveying guide is detachably attached to one of the apparatus main body and the fixing device so as to cover a part of the fixing device from a downstream side in a conveying direction of the sheet, the branching guide is detachably attached to the conveying guide, wherein the conveying guide is attached to the one of the apparatus main body and the fixing device with a fastening member, the branching guide is attached to the conveying guide so as to cover the fastening member.

2. The image forming apparatus according to claim 1, wherein the fixing device includes:

a fixing member which is rotatable and heated by a heat source;

a pressuring member which is rotatable and comes into pressure contact with the fixing member to form a fixing nip; and a separating member which is arranged on the conveying path closer to the downstream side than the fixing nip and separates the sheet from the fixing member, wherein the conveying guide covers the fixing member.

3. The image forming apparatus according to claim 1, wherein the branching guide is turnable between an ejection position where the branching guide rubs on the sheet conveyed toward the downstream side of the conveying path and a reverse conveying prevention position where the branching guide rubs on the sheet conveyed toward the inversion path.

4. The image forming apparatus according to claim 1, wherein the branching guide includes:

a plurality of branching ribs arranged at equal intervals; and a connecting part connecting the plurality of branching ribs.

5. The image forming apparatus according to claim 1, further comprising a cover which closes and opens an opening of the apparatus main body, wherein when the cover opens the opening, a part of the conveying path and a part of the inversion path are exposed.

6. An image forming apparatus comprising:

an apparatus main body in which a conveying path and an inversion path are formed, the conveying path extending from a feeding part for a sheet to an ejecting part for the sheet, the inversion path branching from a portion on a downstream side of the conveying path and joining to a portion on an upstream side of the conveying path;

a fixing device which fixes an image on the sheet conveyed along the conveying path;

a conveying guide which guides the sheet along the conveying path closer to the downstream side than the fixing device; and a branching guide which guides the sheet toward the ejecting part along the conveying path closer to the downstream side than the fixing device and guides the sheet toward the inversion path along the conveying path closer to the downstream side than the fixing device, wherein the conveying guide is detachably attached to one of the apparatus main body and the fixing device so as to cover a part of the fixing device from a downstream side in a conveying direction of the sheet, the branching guide is detachably attached to the conveying guide, the image forming apparatus further comprising:

an opening/closing guide supported by the apparatus main body so as to be turnable between a supporting position where the opening/closing guide supports the conveying guide from a lower side and a leaving position where the opening/closing guide leaves from the lower side of the conveying guide; and a biasing member which biases the opening/closing guide toward the supporting position.

7. The image forming apparatus according to claim 6, wherein the conveying guide rotatably supports a first roller, the opening/closing guide rotatably supports a second roller, and when the opening/closing guide is turned to the supporting position, the second roller comes in pressure contact with the first roller.

8. An image forming apparatus comprising:

an apparatus main body in which a conveying path and an inversion path are formed, the conveying path extending from a feeding part for a sheet to an ejecting part for the sheet, the inversion path branching from a portion on a downstream side of the conveying path and joining to a portion on an upstream side of the conveying path;

a fixing device which fixes an image on the sheet conveyed along the conveying path;

a conveying guide which guides the sheet along the conveying path closer to the downstream side than the fixing device; and a branching guide which guides the sheet toward the ejecting part along the conveying path closer to the downstream side than the fixing device and guides the sheet toward the inversion path along the conveying path closer to the downstream side than the fixing device, wherein the conveying guide is detachably attached to one of the apparatus main body and the fixing device so as to cover a part of the fixing device from a downstream side in a conveying direction of the sheet, the branching guide is detachably attached to the conveying guide, the image forming apparatus further comprising a cover which closes and opens an opening of the apparatus main body, wherein when the cover opens the opening, a part of the conveying path and a part of the inversion path are exposed, the image forming apparatus further comprising an opening/closing guide supported by the apparatus main body so as to be turnable between a supporting position where the opening/closing guide supports the conveying guide from a lower side and a leaving position where the opening/closing guide leaves from the lower side of the conveying guide, wherein the conveying guide rotatably supports a first roller, the opening/closing guide rotatably supports a second roller, the cover rotatably supports a cover roller, wherein a conveying nip is formed along the conveying path between the first roller and the second roller, and an inversion nip is formed along the inversion path between the second roller and the cover roller.

* * * * *